United States Patent [19]

Vinci et al.

[11] 3,974,663

[45] Aug. 17, 1976

[54] DRIVE UNIT IN CIRCULAR HOSIERY MACHINES FOR A DIAL WITH PLATE SHIFT CLUTCH

[75] Inventors: Fernando Vinci, Florence; Dino Morandi, Scandicci, both of Italy

[73] Assignee: Filli S.p.A., Florence, Italy

[22] Filed: Aug. 6, 1974

[21] Appl. No.: 495,148

[30] Foreign Application Priority Data

Aug. 7, 1973 Italy ..... 9581/73

[52] U.S. Cl. ..... 66/26; 66/95; 192/48.91; 192/67 R; 192/93 A; 74/371

[51] Int. Cl.[2] ..... D04B 15/02

[58] Field of Search ..... 66/134, 26, 28, 95, 66/155, 187; 192/48.91, 67 R, 93 R, 93 A; 74/371

[56] References Cited

UNITED STATES PATENTS

| | | | |
|---|---|---|---|
| 2,070,654 | 2/1937 | Gibbs, Jr. et al. | 66/134 |
| 2,213,454 | 9/1940 | Scott | 66/134 |
| 2,392,719 | 1/1946 | Barron | 192/48.91 |
| 2,812,651 | 11/1957 | Bridges, Sr. | 66/155 |
| 2,841,970 | 7/1958 | Saunders | 66/155 |
| 2,844,014 | 7/1958 | Moretta | 66/28 |
| 3,021,699 | 2/1962 | Crawford | 66/28 |
| 3,112,819 | 12/1963 | Eichler et al. | 192/48.91 |
| 3,139,742 | 7/1964 | Lewis | 66/155 |
| 3,252,307 | 5/1966 | Kaese | 66/134 |
| 3,340,707 | 9/1967 | Currier | 66/26 |
| 3,399,551 | 9/1968 | Billi | 66/134 |
| 3,791,175 | 2/1974 | Imboden | 66/26 |
| 3,913,357 | 10/1975 | Lonati | 66/95 |

FOREIGN PATENTS OR APPLICATIONS

| | | | |
|---|---|---|---|
| 1,031,079 | 5/1958 | Germany | 192/48.91 |
| 87,182 | 2/1956 | Norway | 192/48.91 |

*Primary Examiner*—Mervin Stein
*Assistant Examiner*—Andrew M. Falik
*Attorney, Agent, or Firm*—Haseltine, Lake & Waters

[57] ABSTRACT

An arrangement in a circular hosiery machine in which a motion drive device is provided between the needle cylinder and the dial. A program chain advances with each revolution, and a program drum advances intermittently with the action of the chain. A clutch couples and disengages two members of the drive between the cylinder and the dial, and a control of the clutch is made dependent on the program chain. The rotational motion of the dial is interrupted when the members thereof are not required, and an engagement is provided in at least one predetermined relative angular position.

5 Claims, 9 Drawing Figures

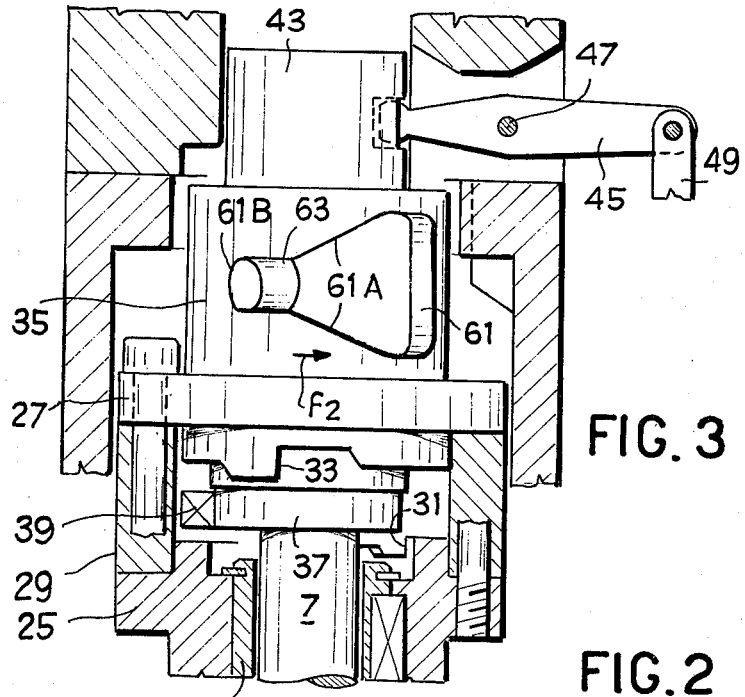
FIG. 3
FIG. 2
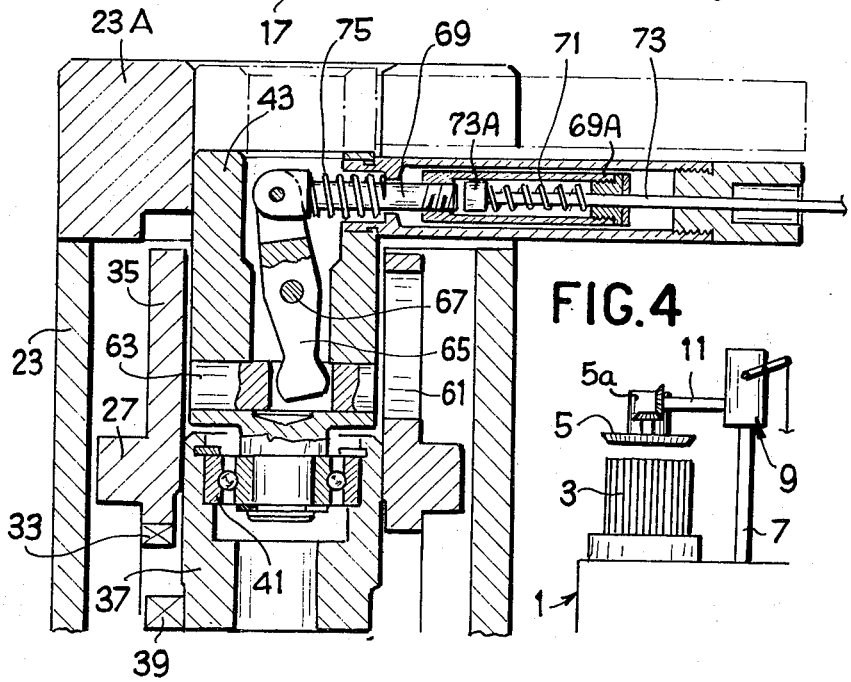
FIG. 4

DRIVE UNIT IN CIRCULAR HOSIERY MACHINES FOR A DIAL WITH PLATE SHIFT CLUTCH

BACKGROUND OF THE INVENTION

The present invention relates to a rotational motion drive device between the needle cylinder and the dial in circular hosiery machines or the like. These are provided with a program chain advancing at each revolution and with a program drum advancing by intermittently with the action of the chain (or of members equivalent to the chain and drum). According to the invention, there is provided a clutch to couple and disengage two drive members between the cylinder and the dial, upon the control of the program chain to interrupt the dial rotational motion when and until the members thereof are not required, and to assure an engagement in one or more well defined relative angular positions.

The device may be provided in machines of the aforesaid kind, which are equipped to create closures of a tubular article according to, for example, U.S. Pat. Nos. 3,340,706 and 3,327,500, and Italian Pat. No. 736,075. To realize the above, shifts or phase displacements must be determined cyclically according to angles smaller than 360° between cylinder and plate. Therefore, the machines in this case involve a double front clutch having a single clutching position and being phase-shifted in the two coupling conditions, with two opposite and shifted front tooth profiles, and with a unit slidable axially to alternatively attain — upon the control of the drum — the two engaging positions with the two opposite profiles.

SUMMARY OF THE INVENTION

According to an embodiment of the present invention, the unit above is also combined with means designed to bring the unit into an intermediate axial disengaging position between two coupling positions, under the control of the so-called program chain.

The interruption of the rotational motion of the dial leads to the advantage of not having to keep the shearing rotating, involving an annular saw member.

A device as described above may include, on the axially movable unit, a rotary portion and a non-rotary portion actuated for the axial movement. According to a advantageous embodiment, on a cylindrical shell integral to the driven member (forming the two front opposite profiles) of the double clutch, there is provided a seat with two opposite inclination profiles, like a seat having a substantially triangular development. On the non-rotary section of the movable unit forming the axially movable drive member, there is provided a rod capable of radially projecting within that seat, when operated by the program chain through a resilient member which is charged in such a manner as to let the same rod penetrate into the seat which is located in front thereof. The seat's inclined profiles determine the movement of the rod and thus of the axially movable unit to the intermediate disengaging position, whichever the position of the rod on the control. A reverse control determines the withdrawal of the rod to allow the control by the program drum. The latter control provides for a drive involving an interposed resilient member.

According to another embodiment, on the non-rotary section of the axially slidable unit — received in said cylindrical shell — there are provided a radial seat for the rod, and a seat for an oscillatory lever actuating the rod, which is operated via means of a resilient member by a flexible drive operated by the turning of the chain.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a sectional view taken along the line II—II of FIG. 1;

FIG. 3 is partial sectional view similar to FIG. 1, in the disengaging and stopping array of the plate;

FIG. 4 is a diagrammatic view of the positioning of the device in the assembly of the machine;

DESCRIPTION OF THE PREFERRED EMBODIMENTS

Figures 1, 1A:
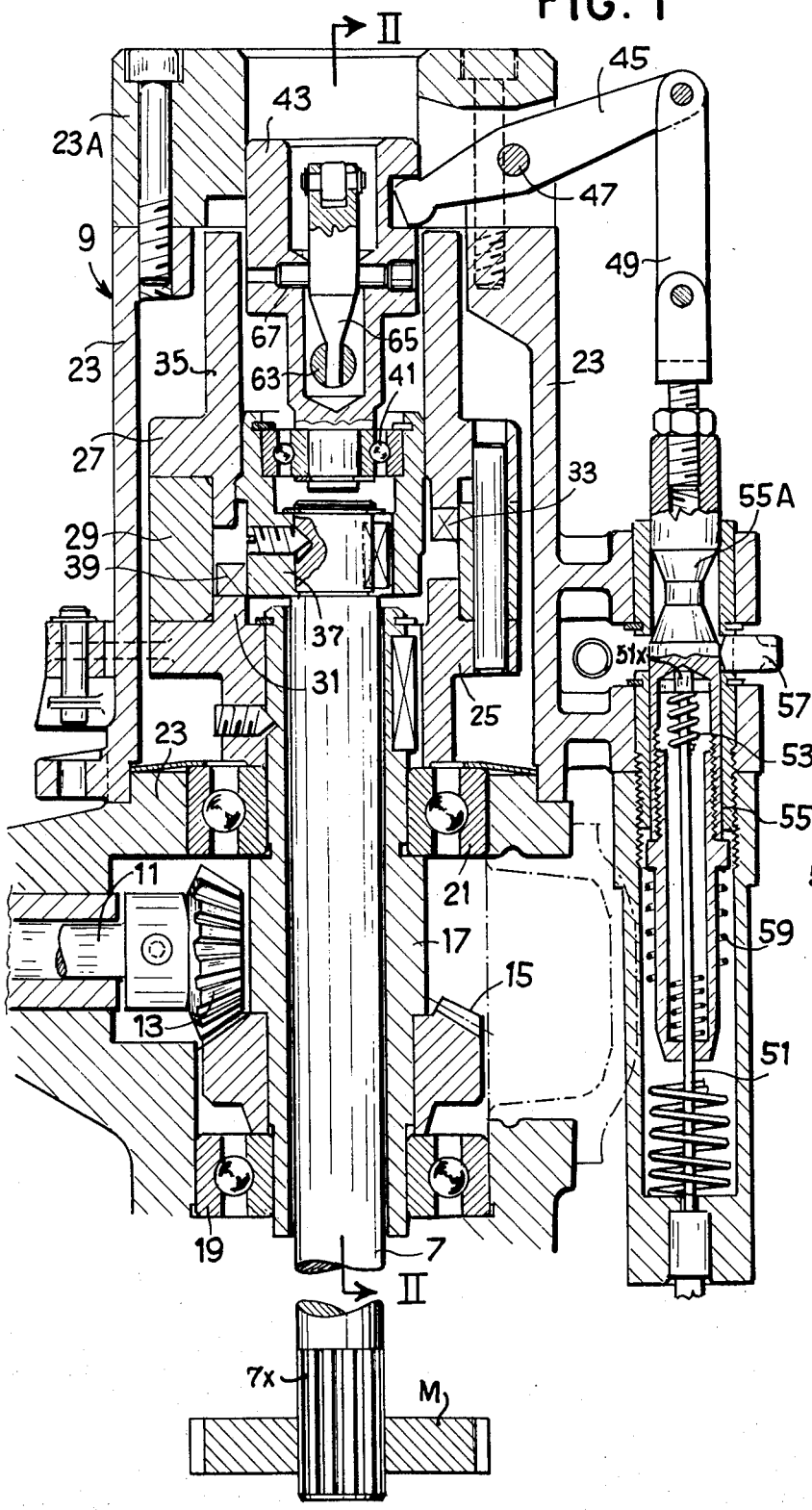
FIG. 1 is a vertical sectional view of the device inserted in the drive between the cylinder and the dial in a machine equipped to form closed toes in accordance with the present invention.
FIG. 1*a* is a partial sectional view of a portion of FIG. 1.
Figure 6:
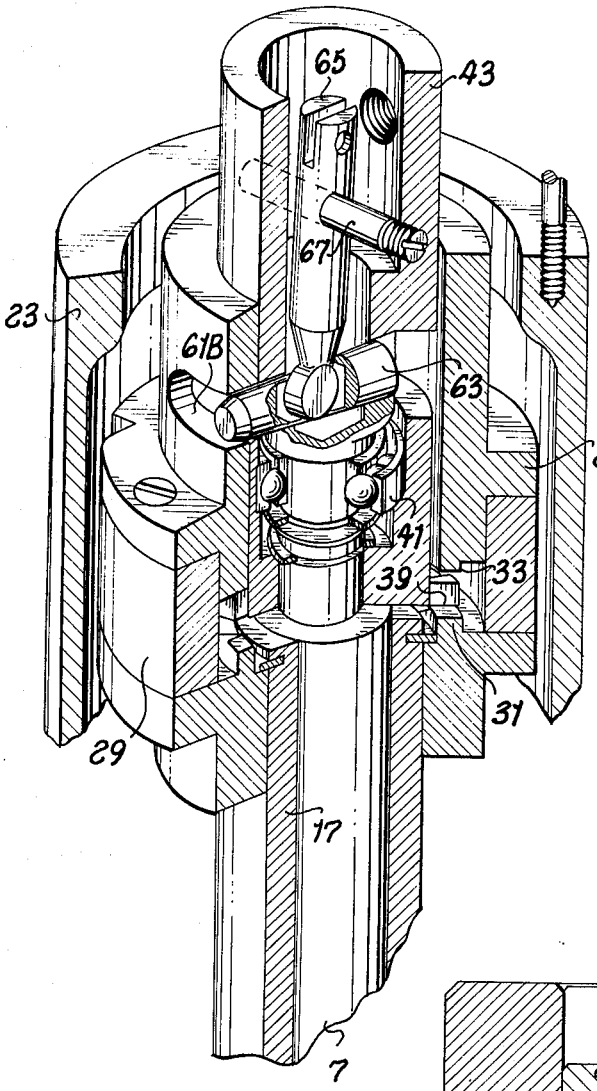
FIG. 6 is a sectional perspective view of a portion of the invention in the assembled state.

In FIG. 4 there is diagrammatically indicated by 1, the machine base from which the cylinder 3 is developed. The dial 5 is arranged coaxially and overlying the cylinder 3, and is actuated in rotation by a drive which includes a shaft 7, the device 9 to be described, and an additional shaft 11. The supporting structures of the several members are not shown, while the device 9 is denoted only by its size.

Figure 2A:
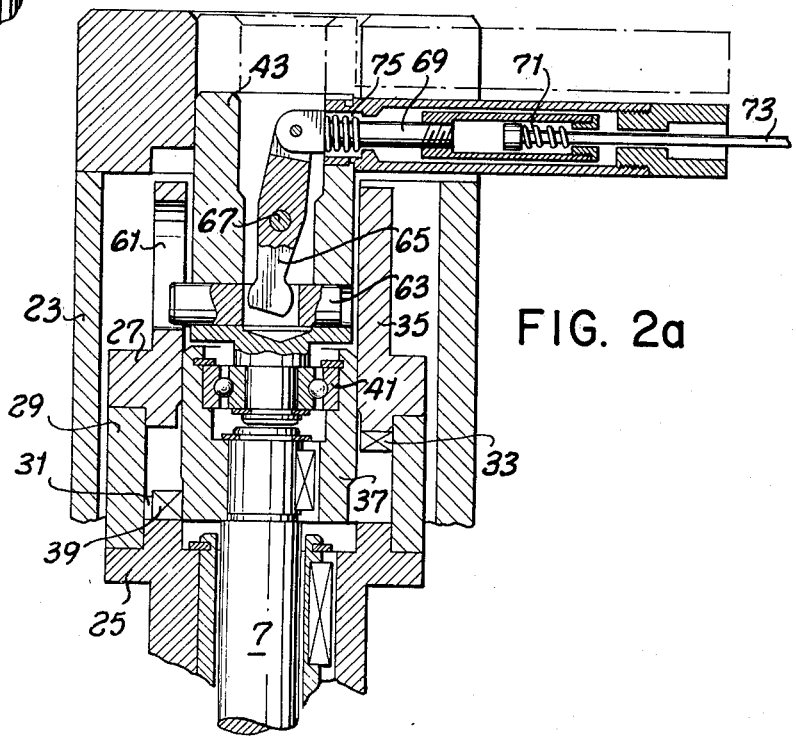
FIG. 2*a* is a sectional of FIG. 2 when the arrangement is in the released position.

With reference to FIGS. 1 to 3, where the shaft 7 and the shaft 11 are shown, the shaft 11 — which is the output shaft of the device to actuate the plate — is driven in rotation by a bevel pinion 13 meshing on a toothed pinion 15 borne by a tubular shaft 17. The latter encloses the shaft 7 and is mounted by means of bearings 19, 21 on the frame 23. At the upper end of the tubular shaft 17, two disc expansions 25 and 27, connected by a spacer 29, define two front tooth profiles 31 and 33 opposite each other. The two teeth are appropriately offset in relation to the desired shift or phase displacement for the dial 5 with respect to the cylinder (for example of 180°) and to the drive ratio between the unit 17, 27 and the dial. The phase displacement is useful to obtain a closed toe. The upper disc expansion 27 extends with a tubular shell 35 always contained in the frame 23. The shaft 7 is capable of axially sliding within the rotor formed by the members 17, 25, 29, 27, 35 which essentially represent the clutch driven member. The shaft 7 represents the drive shaft, and is provided with a grooved sliding profile for its own actuation. In describing further the operation of members 17, if for instance the ratio of member 17 (through 15, 13, 11 and the conical couple to the dial) is in total 1:1, by arranging the teeth 31 and 33 at 180° between each other, one obtains a phase displacement of 180° also in the dial. If, instead, the above drive ratio is, for instance, in total 1:2, the teeth 31 and 33 should be at 90° between each other, so that the dial can be phase-displaced 180° every time.

The lower splined end 7X of shaft 7, which matches with a grooved hole, corresponding to it, of a gear M. The latter is a drive member in a fixed position and transmits the motion to the shaft 7, when this moves axially according to the double arrow. The assembly of members 17, 25, 29, 27 and 35 matches with shaft 7 not with a grooved profile but with the teeth 31 (or 33) on one side and 39 on the other side.

At the upper end, the shaft 7 integrally carries a glass structure 37 provided with a tooth 39 capable of being engaged in the front teeth 31 and 33 alternatively, with the axial movement of the shaft 7 and of the glass-shaped member 37. Passing from the engagement with one to the engagement with the other of the teeth 31 and 33, a delay is determined in the driven section 27, 29, 25, 17, 11 of the drive towards the plate 5. In the passage from one coupling to the other the entrained part 27, 29, 25 rotates slightly less than the drive part 7, 37 and every time in the particular case, remains behind for 180°. According to the present invention, the members 7, 37 either from one or from the other of the engaging positions may be moved into an intermediate axial position between said two engaging positions, in which (see FIG. 3) the tooth 39 remains displaced between the two teeth 31 and 33 without meshing either with one or the other thereof.

In order to obtain the axial movement of the shaft 7 and of the glass-shaped member 37, so as to determine the engagement of the tooth 39 with one or the other of the teeth 31 and 33, the glass-shaped member 37 is engaged by means of a bearing 41 with a slidable but not rotating member denoted by 43. The latter may slide within the tubular shell 35 and within the upper section 23A of the frame 23. For the operation of this member 43, there is provided a small lever 45 linked in 47 to the frame 23, 23A and engaging with the inner end into a notch of the member 43. On the outside, by means of a tie rod linkage 49, the lever 45 is controlled by the program drum. For the drive, provisions are made for a flexible tie rod cable 51 which, by means of a spring 53, acts (against an elastic action) on a member 55 bound to the linkage 49. It also forms a profile 55A capable of operating in a conventionally known manner; levers 57 designed to slightly brake the driven member by acting on the expansion or shoe 55, during the passage from one to the other of the two end engaging positions. The two engaging positions are both kept elastically, one through the spring 53 in series with the cable 51, and the other by means of the spring 59 overcome by the traction action of the cable 51.

The device according to the present invention, allows the attainment of an intermediate position from one or from the other of the engaging positions, and the overcoming of the action of one or of the other of the springs. When, for example, cable 51 is pulled downwardly, it pushes downwardly member 55, 55A — through the very strong spring 53 — compressing the slighter spring 59. If for any reason member 55 is not lowered, then spring 53 is compressed instead of causing the breakage of some member. When cable 51 is no longer pulled downwardly, spring 59 brings again upwards member 55 previously lowered, and the rising of member 55 causes the return upwardly of cable 51 through the spring 57. The tie rod or cable 51 has at the upper end a head 51X, against which spring 57 rests. These arrangements with two springs can be found readily in the prior art.

For this purpose, on the one hand, there is provided on the tubular shell 35 a seat under the form of a window 61 having a triangular development, with two sides 61A symetrically inclined with respect to an intermediate circumference and joining to an end zone 61B at the apex. On the other side on the member 43, there is provided a diametral latch 63 which is capable of assuming an inner position with respect to member 43 (see FIG. 2) or a projecting position wherein it may penetrate into the triangular window seat 61. In the inner position of the latch 63, any axial movement of the unit formed by the non-rotary section 43 and by the rotary sections 7 and 37 is possible, and any rotation of the driven member, of which the shell 35 is a part, is possible. Conversely, when the latch 63, in a manner to be described, is resiliently stressed to, it may penetrate into the window 61 of the rotating shell 35, whatever the axial position of the axially movable unit and the engaging position of the tooth 39 with one or the other of the teeth 31 and 33. Once the latch 63 has penetrated into the window 61, the rotation of the shell 35 in the direction of the arrow f2 of FIG. 3, caused by the drive, determines the sliding of the projecting end of the latch 63 along the one or the other of the inclined sides 61A, until the latch 63 reaches the seat 61B at the middle apex of the window 61. This determines the movement of the axially movable unit to the disengagement of the tooth 39 from the one or the other of the teeth 31 and 33, to an intermediate position wherein there is no actuation by the drive shaft 7 of the driven member 17, 25, 29, 27, 35. The latter is thus stopped, as the dial is stopped. It is to be noted that the movement into the intermediate position by the latch 63, sliding along one of the flanks 61A, is operable under any condition of the control coming from the program drum through the cable 51.

When the movement of the dial is to be re-assumed, the latch 63 is re-entered, and then the control imposed by the program drum through the drive 51, 55, 49, 45 determines the desired engagement on one side or on the other of the front tooth profiles 31, 33, according to the program requirements.

The latch control is actuated (see FIG. 2) through a small lever 65 linked in 67 with the member 43 and operated by a tie rod 69 actuated through the small spring 71 by a cable 73. This cable is actuated by a track especially provided therefor on the program chain. This track imposes a movement of the cable 73, and thus of the lever 65 to it to project and thereby to lock the dial, during the periods of the fabric forming, when there is no necessity of the dial or of the so-called saw shearing device or other device provided on the plate to shear lengths of the yarns which come out or enter into working. Thus, one avoids the wear of the devices located on the plate, when they do not have to accomplish any operation. It is to be noted that the control of the cable 73 determines the loading of the spring 71 to cause the latch 63 to project, and the latter projects as soon as it finds the window 61 which passes in front thereof, during the rotation of the member 35. The spring 75 is active for the return.

Thus, under rest conditions cable 73 does not act. The spring 75 keeps the small lever 65 in the position shown in FIG. 2 inside element 43. When cable 73 is pulled to the right looking at FIG. 2, the end head — designed by 73A — of this cable moves spring 71, and this is compressed and tends to move to the right the tubular element 69A. The latter is integral with the element 69 to which the lever 65 is linked. Thus, spring 71 is tensioned, unless lever 65 can move in clockwise direction. This lever 65 moves in clockwise direction when latch 63 can penetrate into window 61 and the clockwise movement of lever 65 and that to the left of latch 63 are caused by release from spring 71, while the slighter spring 75 is compressed. When cable 73 is slackened to the left, also head 73A moves to the left and thus spring 71 can be relieved. Spring 75 can then also be relieved because the element 69, 69A can slide again to the left. Lever 65 rotates in counter-clockwise direction and latch 63 is brought again in the position of FIG. 2.

Figure 5:
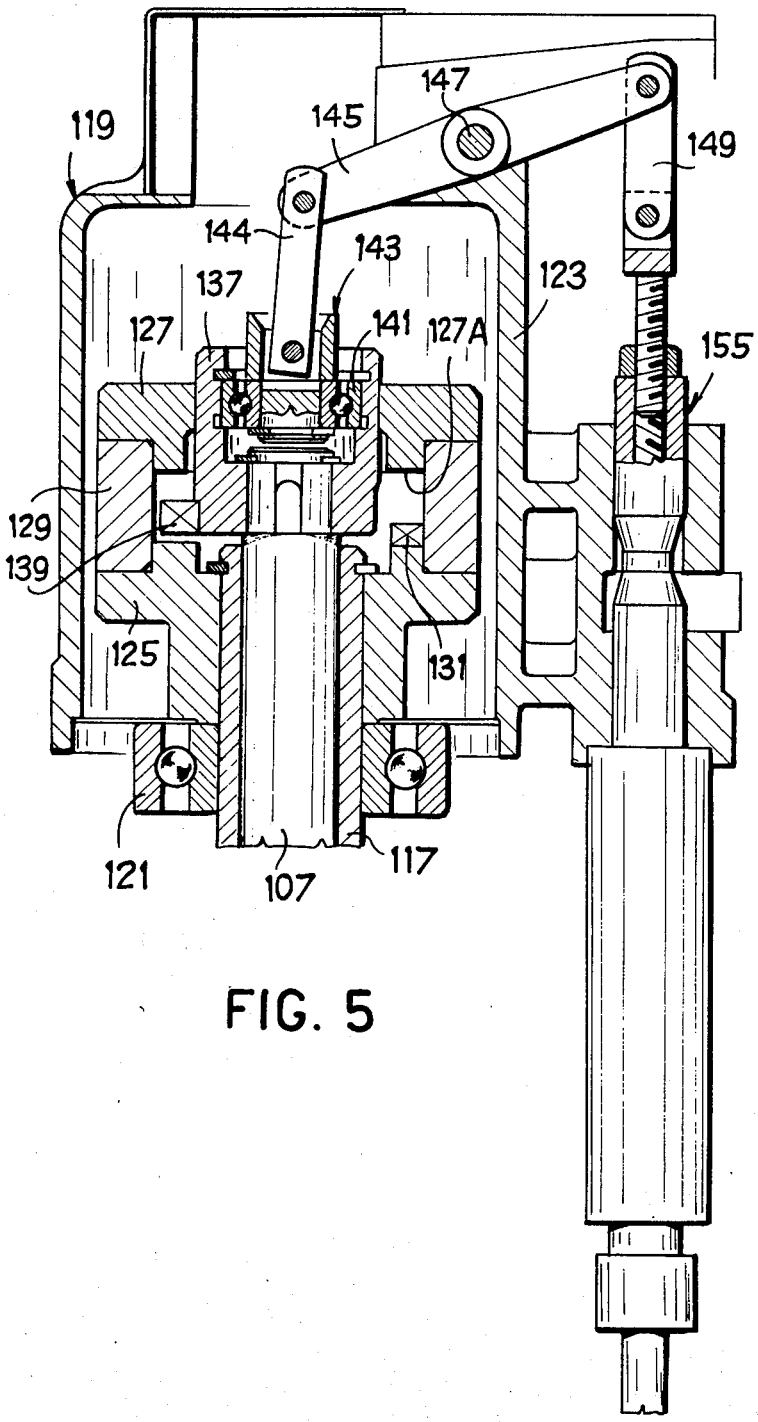
FIG. 5 is a sectional view of an embodiment of the device in conventional machines not provided with the system for the forming of the closure.
Figure 7:
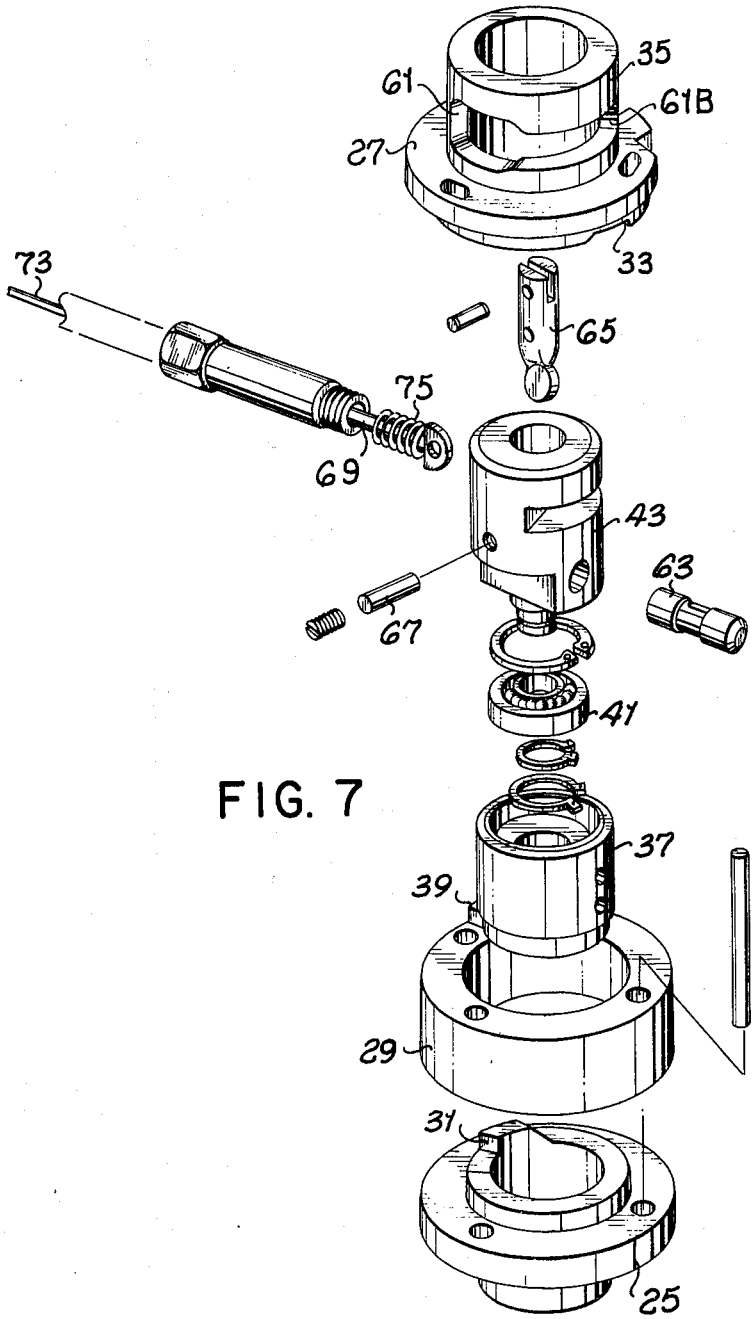
FIG. 7 is an exploded perspective view of elements in FIG. 6.

In FIG. 5 there is shown an embodiment wherein there is provided only a seizing and disengagement clutch between a drive member and a driven member of the drive to the dial. As in the previous case, a shaft 107 transmits the motion from the machine body and respectively from the cylinder. With 117 a tubular shaft is indicated coaxial to the shaft 107, which tubular shaft is assembled on bearings one of which is denoted by 121. Shaft 117 transmits the motion to the plate through bevel gears couplings or the like. In the interior of the casing 123 of the body 119 there is assembled the clutch, which includes two disc expansions 125 and 127 coupled by means of a spacer 129. The expansion 125 has one or more front teeth 131, while the opposite expansion 127 has an inner surface 127A without teeth. In the interior of the recess defined by the two disc expansions 125, 127, a member 137 is sliding back and forth and this member is rotationally coupled to the shaft 107. The unit 107, 137 is capable of sliding axially there being provided a rotational binding coupling sliding axially between a portion of the drive in a fixed position and the shaft 107. The member 137 contains a bearing 141, whose inner ring (race) is borne by a composite core 143, which is not rotating. The core 143, through a small crank 144, is connected to a small lever 145 linked via 147 to the member 23. By means of an additional crank 149, the connection is completed with an actuating member 155 similar to the one denoted by 55, 55A of the previous embodiment. The drive from shaft 11 to dial 5 takes place in a conventional manner i.e., with a couple of conical wheels **5*a*. The drive from shaft 106 to dial 30** takes place with gears, or with the conventional arrangement present in all hosiery machines.

An axial movement of unit 137, 107—and thus the possibility of rotationally coupling the shaft 117 to the shaft 107 through one or more teeth 139 borne by the piece 137 with the tooth or teeth 131, when the unit 137, 107 is moved is initiated by the machine program device by means of the member 155. Conversely, by moving the unit upward, the two shafts 107 and 117 are disengaged, interrupting thereby the rotational motion of the hook disc or dial. The unit 107, 137 may be moved also to remain resting on the surface 127A without the possibility of a coupling, with the surface 127A being without a front toothing.

This second embodiment allows the possibility of providing merely the engagement and the disengagement with a clutch having only two positions, while in the previous embodiment, the clutch had three positions to obtain the shift besides the disengagement. The coupling position is obtained by well defined relative angular positions.

It is intended that the drawing only illustrates an embodiment given as a practical demonstration of the invention, said invention being in conditions as to be varied in the forms and arrangements without, however, departing from the scope of the concept which constitutes the invention. For example, the seat 61 may be replaced by two opposite inclined profiles, as for instance two helical profiles.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptation should and are intended to be comprehended within the meaning and range of equivalents of the following claims.

What is claimed is:

1. An arrangement in a circular machine for stockings and the like comprising, on combination, a needle cylinder, dial means, a motion drive device between said cylinder and said dial means, a clutch to couple and disengage two members of said drive between said cylinder and said dial means, control means of said clutch to interrupt the rotational motion of said dial means at a predetermined instant, and to provide an engagement in at least one predetermined relative angular position and independent control means for obtaining a disengagement position independent of said first-mentioned control means for obtaining the two couplings.

2. The arrangement as defined in claim 1, wherein said dial means comprises a dial disc.

3. An arrangement in a circular machine for hosiery, tubular articles and the like, comprising a needle cylinder, dial means, a motion drive device between said cylinder and said dial means, closure means to form closures of the tubular article according to angles smaller than 360° between cylinder and dial, said closure means comprising a double front clutch shifted in two coupling conditions, with two opposite and shifted front tooth profiles, an axially slidable unit to alternatively reach two engaging positions with the two opposite profiles, means for bringing said unit into an axial intermediate disengaging position between said two engaging positions, said means being actuated to interrupt the rotational motion of said dial means at a predetermined instant.

4. An arrangement in a circular machine for hosiery, tubular articles and the like, comprising a needle cylinder, dial means, a motion drive device between said cylinder and said dial means, closure means to form closures of the tubular article according to angles smaller than 360° between cylinder and dial, said closure means comprising a double front clutch shifted in two coupling conditions, with two opposite and shifted front tooth profiles, an axially slidable unit to alternatively reach two engaging positions with the two opposite profiles, means for bringing said unit into an axial intermediate disengaging position between said two engaging positions, said means being actuated to interrupt the rotational motion of said dial means at a predetermined instant, a cylindrical shell integral with the driven member, said shell forming two opposite front profiles of the double clutch and a seat with two opposite inclination profiles, a non-rotary section of the movable unit forming an axially movable drive member on said non-rotary section, a latch susceptible of projecting within said seat, control means including an elastic member being charged or loaded so as to let said latch penetrate into the seat presented in front thereof, the active one of the inclined profiles determining the movement of the latch and thereby of the axially movable unit to the intermediate disengaging position independent of the position of the latch.

5. The arrangement as defined in claim 4, including an oscillatory lever that actuates the latch, and control means of said lever comprising an elastic member and a flexible drive, said non-rotary section of the axially slidable unit forming a radial seat for the latch and a seat for a lever.

* * * * *